US010946681B2

(12) United States Patent
He et al.

(10) Patent No.: US 10,946,681 B2
(45) Date of Patent: Mar. 16, 2021

(54) PRINTING CONTROL METHOD AND PRINTING DEVICE

(71) Applicant: SHENZHEN DANYA TECHNOLOGY CO., LTD., Guangdong (CN)

(72) Inventors: Peng He, Shenzhen (CN); Zhenqing Lin, Shenzhen (CN)

(73) Assignee: SHENZHEN DANYA TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/502,893

(22) Filed: Jul. 3, 2019

(65) Prior Publication Data

US 2020/0086666 A1 Mar. 19, 2020

(30) Foreign Application Priority Data

Sep. 18, 2018 (CN) ..... 2018 1 1086524

(51) Int. Cl.

*B41J 29/393* (2006.01)
*B41J 29/38* (2006.01)
*B41J 2/01* (2006.01)
*B41J 11/00* (2006.01)

(52) U.S. Cl.

CPC ..... *B41J 29/393* (2013.01); *B41J 2/01* (2013.01); *B41J 29/38* (2013.01); *B41J 11/008* (2013.01)

(58) Field of Classification Search

CPC ... B41J 29/393; B41J 29/38; B41J 2/01; B41J 11/008; B41J 2/04501

See application file for complete search history.

(56) References Cited

U.S. PATENT DOCUMENTS 5,605,407 A * 2/1997 Hama ..... B41J 19/202 347/37
5,953,024 A 9/1999 Lee et al.
(Continued)

FOREIGN PATENT DOCUMENTS

CN 202965529 U 6/2013
CN 204020261 U 12/2014
CN 104802526 A 7/2015
(Continued)

OTHER PUBLICATIONS

First Office Action in Chinese Application No. 201811086524.1 dated Feb. 3, 2020, 21 Pages.

*Primary Examiner* — Geoffrey S Mruk
(74) *Attorney, Agent, or Firm* — Metis IP LLC

(57) ABSTRACT

The present disclosure provides a printing control method, a printing control apparatus, a storage medium, and a printing device. The printing control method may be used for resetting a printing platform of the printing device to a preset starting position, including: detecting whether the limit switch is in a trigger state when receiving an electrical power-on signal of the printing device or a start printing command; controlling the printing platform to move according to a state of the limit switch and a corresponding route strategy; and controlling the printing platform to stop moving at the preset starting position when the state of the limit switch is detected that changed from a non-trigger state to a trigger stat, so that the printing platform stops at the preset starting position.

10 Claims, 11 Drawing Sheets

(56) References Cited

U.S. PATENT DOCUMENTS

| | | | |
|---|---|---|---|
| 6,036,384 | A | 3/2000 | Suzuki |
| 2002/0018094 | A1 | 2/2002 | Iwaya et al. |

FOREIGN PATENT DOCUMENTS

| | | | |
|---|---|---|---|
| JP | H11170650 | A | 6/1999 |
| JP | 2007331272 | A | 12/2007 |
| JP | 2009298061 | A | 12/2009 |
| JP | 2010213424 | A | 9/2010 |

* cited by examiner

PRINTING CONTROL METHOD AND PRINTING DEVICE

CROSS-REFERENCE TO RELATED APPLICATIONS

This application claims priority to Chinese Patent Application No. 201811086524.1, filed on Sep. 18, 2018, the contents of which are incorporated herein by reference in their entirety.

TECHNICAL FIELD

The present disclosure embodiment relates to the field of a communication technology, in particular to a printing control method, a printing control apparatus, a storage medium and a printing device.

BACKGROUND

In life, a printing device is a commonly used office device. Generally, an inkjet printing device prints texts, images, and other information via a movement of a print head. Raster strips are commonly used as a ruler in the printing device for precisely positioning a motor during printing. At present, raster positioning method positions the print head's starting point by physically striking the sides of the printing device and detecting changes using photoelectric. This method generates noise and causes jitter of the print head when it strikes the two side walls of the printing device, resulting in inaccurately positioning of the starting point. As a result, inaccurately positioning of the starting point further causes shifts of the printed image.

Accordingly, there is a need to more accurately reset the printing platform of the printing device to preset starting position.

SUMMARY

The present disclosure embodiment provides a printing control method, a printing control apparatus, a storage medium and a printing device for accurately resetting the printing platform of the printing device to preset starting position.

In a first aspect, the present disclosure provides a printing control method for resetting a printing platform of a printing device to a preset starting position, comprising: detecting a state of a limit switch of the printing device when receiving an electrical power-on signal of the printing device or a start printing command, the state of the limit switch including a trigger state or a non-trigger state; moving the printing platform according to the state of the limit switch and a route strategy; and controlling the printing platform to stop moving at the preset starting position when the state of the limit switch is changed from the non-trigger state to the trigger state.

In a second aspect, the present disclosure embodiment also provides a printing control apparatus, comprising: a limit switch detection module configured to detect a state of a limit switch of a printing device when receiving an electrical power-on signal of the printing device or a start printing command, the state of the limit switch including a trigger state or a non-trigger state; a moving route control module configured to move a printing platform of the printing device according to the state of the limit switch and a route strategy; and a starting point determination module configured to control the printing platform to stop moving at the preset starting position when the state of the limit switch is changed from the non-trigger state to the trigger state.

In a third aspect, the present disclosure embodiment provides a non-transitory computer readable storage medium storing instructions, the instructions, when executed by a processor, caused the processor to implement the printing control method as described in the first aspect.

In a fourth aspect, the present disclosure embodiment provides a printing device comprising a frame, a motor, a slider, a printing platform, a limit switch, and a trigger board. The motor is fixed to the frame and configured to drive the printing platform to move along the slider. The slider is fixed along a longitudinal direction of the frame. One of the limit switch or the trigger board is fixed on the printing platform, and the other of the limit switch or the trigger board is fixed to an end of the slider to define a preset starting position, wherein when the one of the limit switch or the trigger board fixed on the printing platform moves to the preset starting position, the limit switch is in a trigger state and generates a first trigger signal; when the one of the limit switch or the trigger board fixed on the printing platform moves away from the preset starting position, the limit switch is in a non-trigger state and generates a second trigger signal.

The print control method provided in the embodiment of the present disclosure determines whether the limit switch is in the trigger state according to the electrical power-on signal or the start printing command and controls the printing platform to move according to the state of the limit switch and the corresponding route strategy. When the state of the limit switch is detected that changed from the non-trigger state to the trigger state, the motor stops, and the position of the printing platform when the motor is stopped is set as the starting point of the printing operation. Therefore, even if the printing device shift from the preset starting position before the printing device is powered on, or the printing platform shift from the preset starting position before the printing job starts, the preset starting position of the printing platform may also be automatically found according to the electrical power-on signal or the start printing command, without a manual adjustment, avoiding a printing device error, and improving a positioning accuracy. In addition, the limit switch used in this case is a light-sensitive limit switch. When the printing device performs the preset starting position resetting process, there is no need to collide the limit switch, so the resetting process basically has no noise.

BRIEF DESCRIPTION OF THE DRAWINGS

FIG. 8 is a schematic structural diagram of a printing control apparatus provided according to a seventh embodiment of the present disclosure;

DETAILED DESCRIPTION

Figure 1:
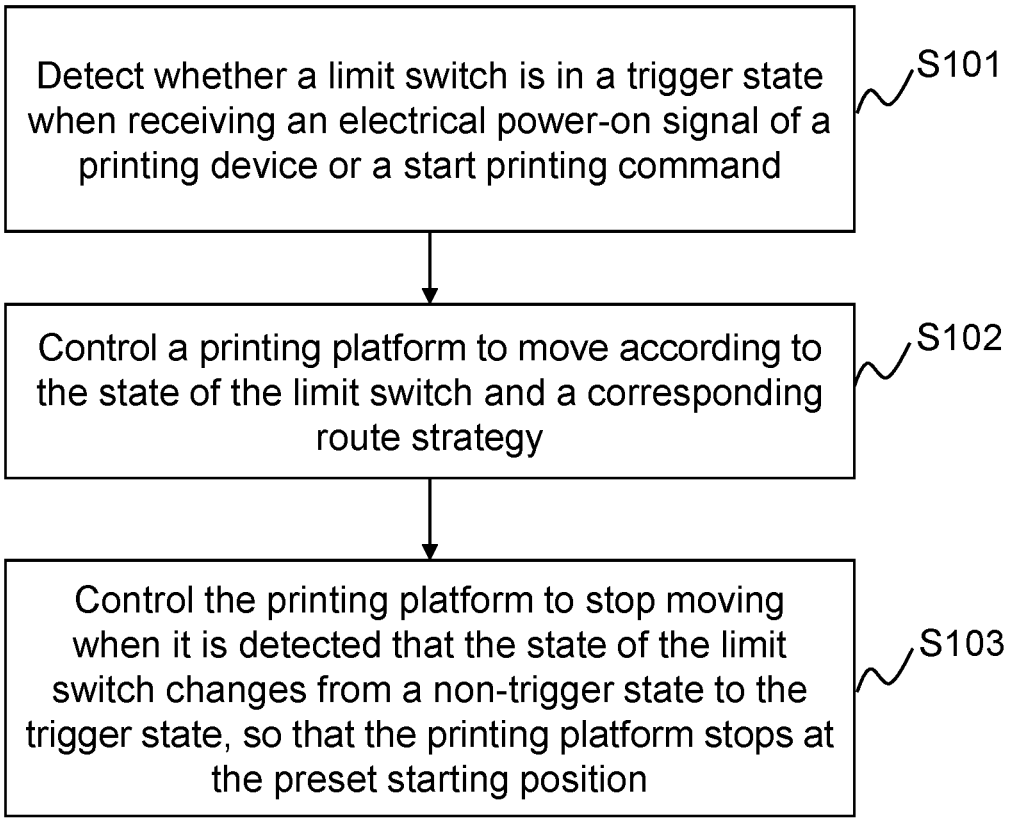
FIG. 1 is a flow chart of a printing control method provided according to a first embodiment of the present disclosure.

The present disclosure will be further described in detail below with reference to the accompanying drawings and embodiments. It is understood that the specific embodiments described herein are merely illustrative of the present disclosure, rather than the limitation of the present disclosure. In addition, it should be noted that, for the convenience of description, only some, but not all, structures related to the present disclosure are shown in the drawings.

It should be mentioned before discussing the embodiment in more details that some exemplary embodiments are described as processes or methods depicted as flow charts. Although the flow charts describe each step as a sequential process, many of the steps may be implemented in parallel, concurrently, or simultaneously. In addition, the order of the steps may be rearranged. The process may be terminated when its operation is completed but may also have additional steps not included in the figures. The process may correspond to a method, a function, a procedure, a subroutine, a subroutine, etc.

Embodiment One

FIG. 1 is a flow chart of a printing control method provided according to a first embodiment of the present disclosure. The method may be suitable for pattern printing on a surface of a nail, e.g., decorating the nail by printing a pattern on the surface of the nail. The printing platform including a print head after stopping printing will return to a preset starting position. However, since the object to be printed is a human finger, the printing platform may shift from the preset starting position caused by a finger touch, a collision vibration, or errors accumulated during continuous movements. Therefore, it is necessary to reset the preset starting position of the printing platform when the printing device is powered on or before the start of a printing job, so as to perform an accurate printing. The printing device of this embodiment includes at least a processor, a storage, and a printing module. The printing module may include a motor, a slider, a limit switch, a trigger board, a distance measuring apparatus, and a printing platform. The printing platform may comprise a print head, such as an inkjet print head. The printing platform may be driven by the motor to move back and forth along the slider to search a printing region. The limit switch is used in conjunction with the trigger board to detect whether the printing platform moves to the preset starting position. The distance measuring apparatus is used to calculate the movement distance of the printing platform. In this embodiment, a photoelectric limit switch without physical collision is used, and instructions corresponding to the method in this embodiment may be executed by the processor of the printing device, and the method specifically includes operations as described below.

S101, the printing device may detect whether the limit switch is in a trigger state when receiving the electrical power-on signal of the printing device or the start printing command.

S102, the printing device may control the printing platform to move according to the detected state of the limit switch and a corresponding route strategy.

S103, the printing device may control the printing platform to stop moving when it is detected that the state of the limit switch changes from a non-trigger state to the trigger state, so that the printing platform stops at the preset starting position.

For the step S101, in one embodiment, a nail printing device is provided with a separate power button, and the user presses the power button to generate the power-on signal and send it to the processor. The nail printing device enters a reset process according to the electrical power-on signal and starts to detect whether the limit switch is in the trigger state. After the reset is completed, the printing platform stops at the preset starting position. In another embodiment, a print button is displayed on a touch panel of the nail printing device, and the user clicks the print button to generate the start printing command and send it to the processor. The nail printing device enters the reset process according to the start printing command and detects whether the limit switch is in the trigger state. After the reset is completed, the printing platform stops at the preset starting position, and then enters the printing process.

In some embodiments, the limit switch may be a photoelectric limit switch, and the photoelectric limit switch includes two oppositely disposed pins for transmitting and receiving optical signal. The trigger board may be used to block the optical path between the two pins of the photoelectric limit switch. In one embodiment, one of the limit switch or the trigger board is fixed on the printing platform, and the other of the limit switch or the trigger board is fixed to an end of the slider to define the preset starting position. In some embodiments, the limit switch is fixed on the printing platform, and the trigger board is fixed adjacent to one end of the slider to define the preset starting position. When the limit switch is in the preset starting position, the optical path between the two pins is blocked by the trigger board, and the photoelectric limit switch generates a first trigger signal of a low voltage. When the photoelectric limit switch leaves the preset starting position, the optical path between the two pins of the photoelectric limit switch is not blocked by the trigger board, and the photoelectric limit switch generates a second trigger signal of a high voltage. Therefore, the processor determines whether the photoelectric limit switch is in the trigger state according to the first or the second trigger signal provided by the photoelectric limit switch, that is, whether the photoelectric limit switch is in the preset starting position and whether the optical path between the photoelectric limit switches is blocked by the trigger board. In an alternative embodiment, the trigger board is fixed on the printing platform, and the limit switch is fixed adjacent to the end of the slider to define the preset starting position.

Figure 2:
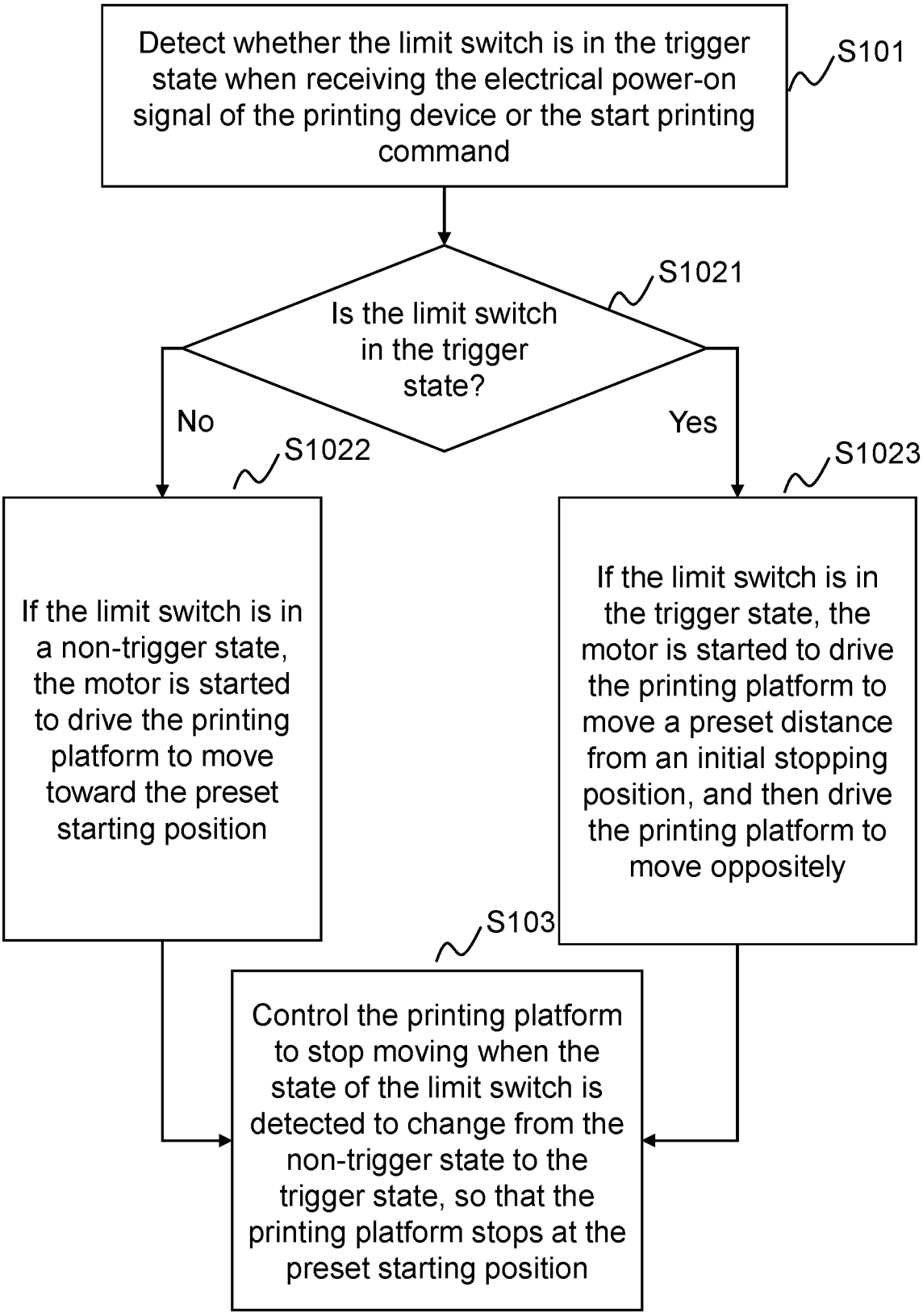
FIG. 2 is a flow chart of controlling the movement of a printing platform according to the first route strategy and the second route strategy in the printing control method provided according to the first embodiment of the present disclosure.

For the step S102, in some embodiments, if the limit switch is in the trigger state, since it is uncertain whether the printing platform shifts from the preset starting position, e.g., the printing platform may have passed the preset starting position due to an external force, it is necessary to re-confirm the starting point of the printing platform. In this situation, the processor controls the printing platform to move according to a first route strategy. For example, the printing platform is driven to move from an initial stopping position of the printing platform, and move oppositely after moving a preset distance from the initial stopping position. When the state of the limit switch is detected to change from the non-trigger state to the trigger state, the move stops, and the position of the printing platform when the motor stops is determined as the preset starting position of the printing platform. The preset distance here needs to satisfy that when the platform moves the preset distance, the limit switch changes from the trigger state to the non-trigger state. If the limit switch is in the non-trigger state, it indicates that the printing platform shifts a certain distance from the preset starting position. In this situation, the processor controls the printing platform to move according to a second route strategy. For example, the motor is started to drive the printing platform to directly move toward the preset starting position. In this embodiment, the step of controlling the printing platform to move according to the first route strategy and the second route strategy may be described in S1021-S1023 in FIG. 2. In some embodiments, a direction in which the printing platform moves from the initial stopping position is not limited. The printing platform may be moved toward the printing region or toward the end of the slider. The trigger board may have a certain length and a structure for a distance of the movement when the printing platform moving toward the slider end.

For the step S103, when the state of the limit switch is detected to change from the non-trigger state to the trigger state, the motor stops. The stop position of the printing platform is determined as the preset starting position of the printing platform when the motor stops, so as to reset the printing platform of the printing device to the preset starting position.

Compared to the prior art, the printing control method of this embodiment determines whether the limit switch is in the trigger state according to the electrical power-on signal or the start printing command and controls the printing platform according to the state of the limit switch and the corresponding route strategy. When the state of the limit switch is detected to change from the non-trigger state to the trigger state, the control motor stops, and the position of the printing platform when the motor stops is determined as the preset starting position of the printing platform. Therefore, even if the printing platform shifts from the preset starting position before the printing device is powered-on, or the printing platform shifts from the preset starting position before the printing job starts, the accurate start point of the printing platform may also be automatically found according to the reset process triggered by the electrical power-on signal or the start printing command, without the manual adjustment, avoiding the printing device error, and improving the positioning accuracy, thereby improving the printing precision. In addition, the limit switch used in this case is the light-sensitive limit switch. When the printing device performs the reset process, there is no need to collide the limit switch, so the reset process has no noise.

Embodiment Two

Figure 3:
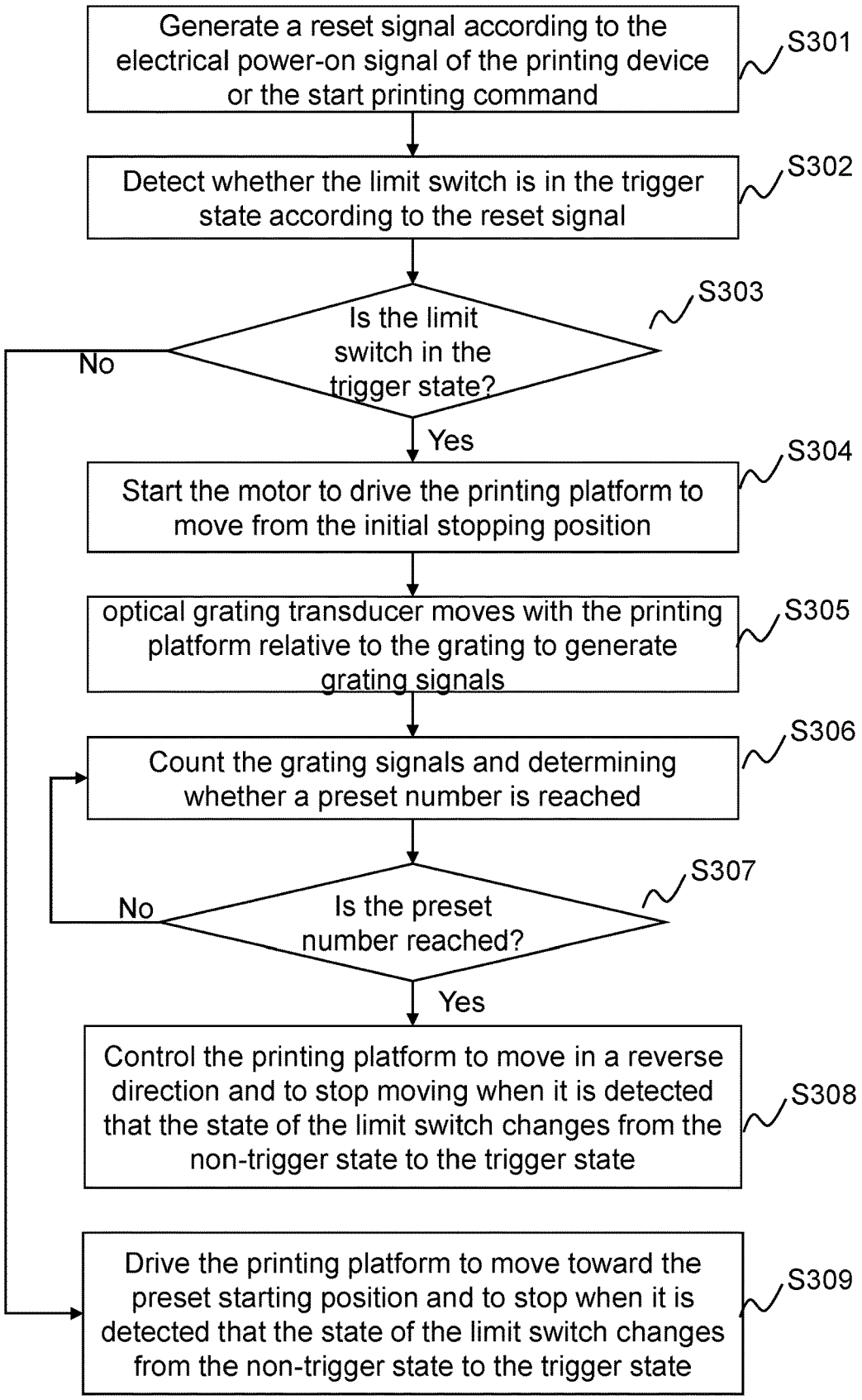
FIG. 3 is a flow chart of the printing control method provided according to a second embodiment of the present disclosure.

FIG. 3 is a flow chart of the printing control method provided according to a second embodiment of the present disclosure. Based on the embodiment, the printing control method of this embodiment specifically includes operations as described below.

S301, the printing device may generate a reset signal according to an electrical power-on signal of the printing device or a start printing command.

S302, the printing device may detect whether the limit switch is in a trigger state according to the reset signal.

S303, the printing device may determine whether the limit switch is in the trigger state. If the limit switch is in the trigger state, step S304 is executed, otherwise step S309 is executed.

S304, the printing device may start the motor to drive the printing platform to move from an initial stopping position.

S305, the optical grating transducer moves with the printing platform relative to the grating to generate grating signals.

S306, the printing device may count the grating signals and determine whether a preset number counts is reached.

S307, if the preset number counts is reached, step S308 is executed, otherwise step S306 is executed continually.

S308, if a number counts of the grating signals reaches the preset number counts, the printing device may control the printing platform to move in a reverse direction. The motor is controlled to stop when it is detected that the state of the limit switch changes from the non-trigger state to the trigger state, so that the printing platform stops at the preset starting position.

S309, if the limit switch is in the non-trigger state, the motor is started to drive the printing platform to move toward the preset starting position. The motor is controlled to stop when it is detected that the state of the limit switch changes from the non-trigger state to the trigger state, so that the printing platform stops at the preset starting position.

For the step S301, in this embodiment, the printing device may further generate the reset signal according to the electrical power-on signal of the printing device or the start printing command, and the printing device may perform the reset process, so that the printing platform stops at the preset starting position.

For the step 304, in some embodiments, the initial stopping position is an actual stopping position of the printing platform before the printing device is powered on, or the actual stopping position of the printing platform before the start printing command is triggered.

For the steps S303-S309, in some embodiments, the distance measuring apparatus may include a grating module, and the grating module may include a grating and an optical grating transducer. The grating is set to be parallel with the direction of the slider. The optical grating transducer is fixed on the printing platform and coupled with the grating when synchronously sliding with the printing platform. The optical grating transducer of the grating module moves with the printing platform along the slider. During the movement, a grating signal is generated for each passed grating, and the grating signals are counted. When a number counts of the grating signals reaches the preset number counts, the printing platform is considered to move to a region where the limit switch is in the non-trigger state. For example, a distance from the preset starting position to the region is a preset distance, and the limit switch is in the non-trigger state when the printing platform moves the preset distance. In some embodiments, the preset number counts of the grating signals may be between 500 and 700, for example, 600. In this embodiment, since the grating module is used to calculate the preset distance, it is advantageous to accurately and quickly move the printing platform to perform the resetting of the preset starting position.

Embodiment Three

Figure 4:
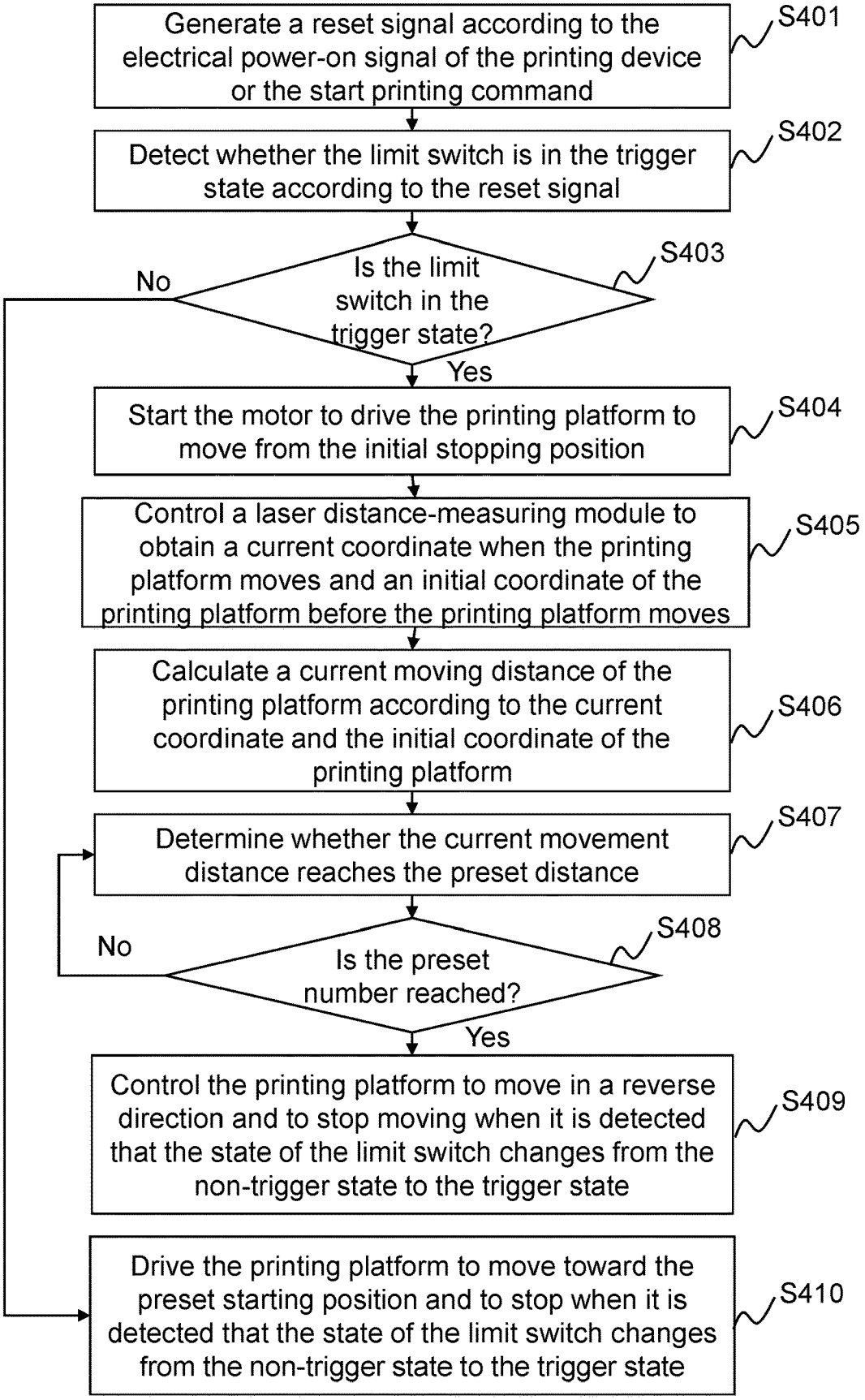
FIG. 4 is a flow chart of the printing control method provided according to a third embodiment of the present disclosure.

FIG. 4 is a flow chart of the printing control method provided according to a third embodiment of the present disclosure. Based on the embodiment, the printing control method of this embodiment specifically includes operations as described below.

S401, the printing device may generate a reset signal according to an electrical power-on signal of the printing device or a start printing command.

S402, the printing device may detect whether the limit switch is in a trigger state according to the reset signal.

S403, the printing device may determine whether the limit switch is in the trigger state. If the limit switch is in the trigger state, step S404 is executed, otherwise step S410 is executed.

S404, the printing device may start the motor to drive the printing platform to move from an initial stopping position.

S405, the printing device may control a laser distance-measuring module to obtain a current coordinate when the printing platform moves and an initial coordinate of the printing platform before the printing device moves.

S406, the printing device may calculate a current moving distance of the printing platform according to the current coordinate and the initial coordinate of the printing platform.

S407, the printing device may determine whether the printing platform movement reaches a preset distance according to the current movement distance.

S408, if the preset distance is not reached, step S407 is executed continually; otherwise step S409 is executed.

S409, if the preset distance is reached, the printing platform moves in the reverse direction. The motor is controlled to stop moving when it is detected that the state of the limit switch changes from the non-trigger state to the trigger state, so that the printing platform stops at the preset starting position.

S410, if the limit switch is in the non-trigger state, the motor is started to drive the printing platform to move toward the preset starting position. The motor is controlled to stop when it is detected that the state of the limit switch changes from the non-trigger state to the trigger state, so that the printing platform stops at the preset starting position.

For the steps S405-S408, in some embodiments, the distance measuring apparatus includes the laser distance-measuring module, and the moving coordinate of the printing platform may be accurately determined. Therefore, the accuracy of the recognition of the preset distance may be controlled, and the printing platform may be accurately moved to perform the resetting of the preset starting position.

Embodiment Four

Figure 5:
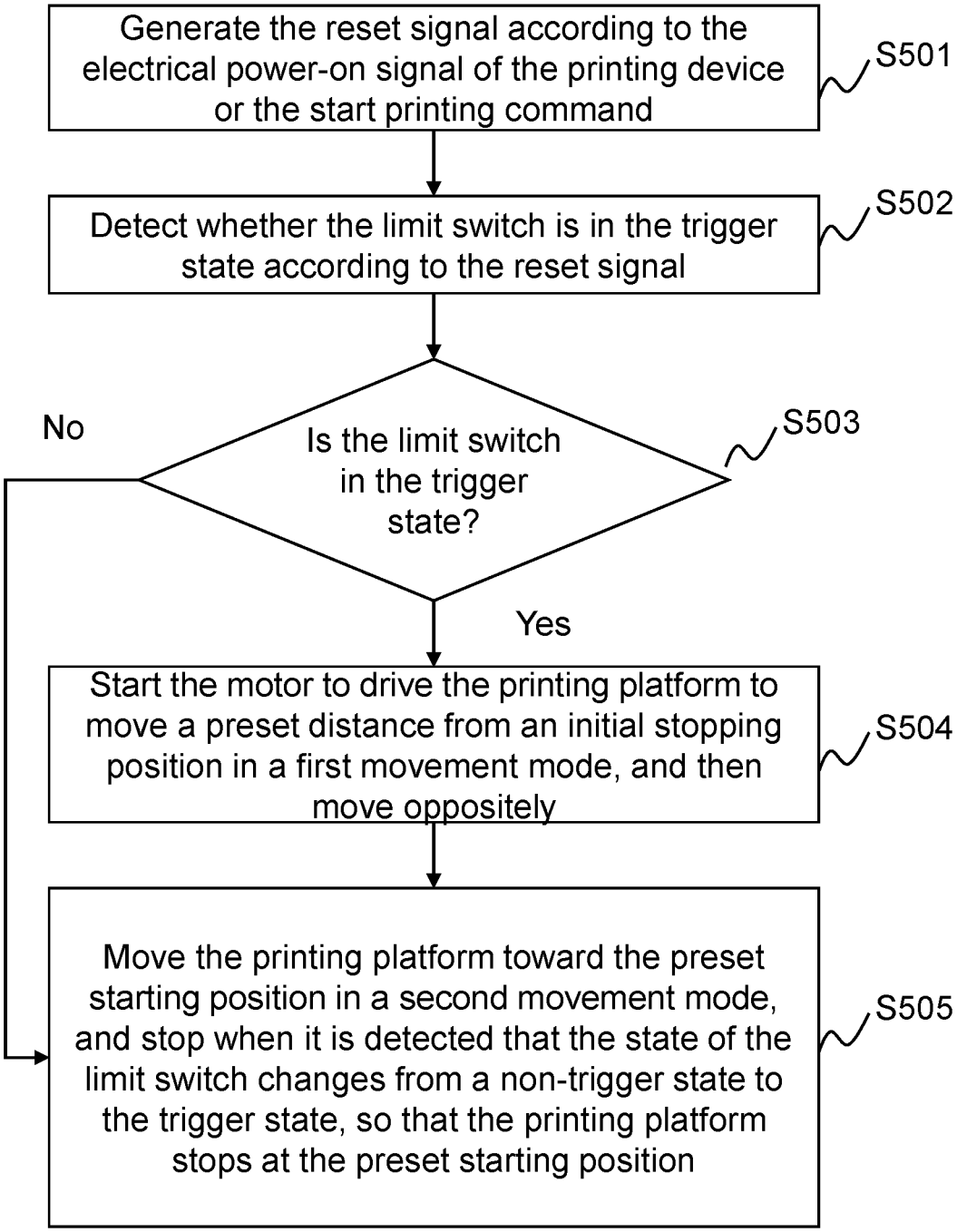
FIG. 5 is a flow chart of the printing control method provided according to a fourth embodiment of the present disclosure.

FIG. 5 is a flow chart of the printing control method provided according to a fourth embodiment of the present disclosure. Based on the embodiment, the printing control method of this embodiment specifically includes:

S501, the printing device may generate a reset signal according to an electrical power-on signal of the printing device or a start printing command.

S502, the printing device may detect whether the limit switch is in a trigger state according to the reset signal.

S503, the printing device may determine whether the limit switch is in the trigger state. If the limit switch is in the trigger state, step S504 is executed, otherwise step S505 is executed.

S504, the printing device may start the motor to drive the printing platform to move a preset distance from an initial stopping position in a first movement mode, and then move oppositely.

S505, the printing device may control the printing platform to move toward the preset starting position in a second movement mode, and the motor is controlled to stop when it is detected that the state of the limit switch changes from a non-trigger state to the trigger state, so that the printing platform stops at the preset starting position.

For the steps S504-S505, in this embodiment, during the resetting of the preset starting position of the printing platform, the movement mode of the printing platform is adjustable. The motor is started to drive the printing platform to move from the initial stopping position using the first movement mode and then move oppositely. The printing platform is moved in the reverse direction toward the preset starting position in the second movement mode. In this embodiment, the first movement mode is different from the second movement mode. For example, although the first movement mode and the second movement mode are both uniform motions, a first speed of the first movement mode is greater than a second speed of the second movement mode, so that the printing platform is driven to move toward the preset starting position at a lower speed. Therefore, an inertia effect of the printing platform may be reduced when the preset starting position is triggered, and the shift of the preset starting position of the printing platform due to the inertia may be avoided.

Embodiment Five

Figure 6:
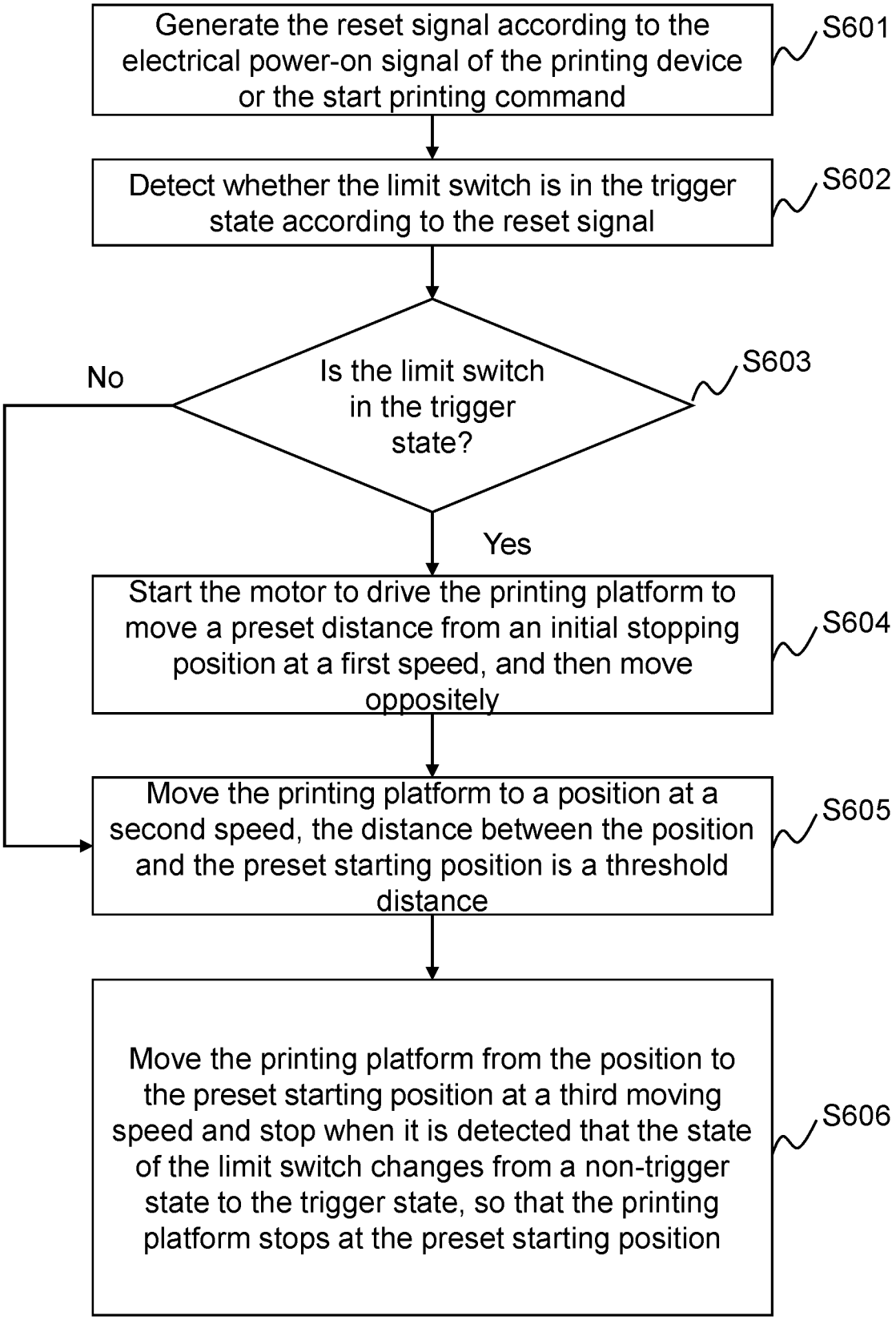
FIG. 6 is a flow chart of the printing control method provided according to a fifth embodiment of the present disclosure.

FIG. 6 is a flow chart of the printing control method provided according to a fifth embodiment of the present disclosure. Based on the embodiment, the printing control method of this embodiment specifically includes operations as described below.

S601, the printing device may generate a reset signal according to an electrical power-on signal of the printing device or a start printing command.

S602, the printing device may detect whether the limit switch is in a trigger state according to the reset signal.

S603, the printing device may determine whether the limit switch is in the trigger state. If the limit switch is in the trigger state, step S604 is executed, otherwise step S605 is executed.

S604, the printing device may start the motor to drive the printing platform to move a preset distance from an initial stopping position at a first speed, and then move oppositely.

S605, the printing device may control the printing platform to move to a position at a second speed, the distance between the position and the preset starting position is a threshold distance.

S606, the printing device may control the printing platform to move from the position to the preset starting position at a third speed. The motor is controlled to stop when it is detected that the state of the limit switch changes from a non-trigger state to the trigger state, so that the printing platform stops at the preset starting position.

For the steps S604-S606, in this embodiment, during the resetting process, the movement mode of the printing platform is adjustable. The printing platform moves in a first movement mode from the initial stopping position, and the printing platform moves to the preset starting position in a second movement mode. In this embodiment, the first movement mode is a uniform motion, and the second movement mode is a shifting motion including at least two speeds. For example, the printing platform moves at the second speed when a distance between the printing platform and the preset starting position is larger than the threshold distance, and the printing platform moves at the third speed when the distance between the printing platform and the preset starting position is smaller than the threshold distance. The third speed is less than the second speed, and the second speed is less than or equal to the first speed. The threshold distance may be determined by the above referenced grating module or the laser distance-measuring module. In one embodiment, the threshold distance may be set to be a distance of 50-100 grating signals from the preset starting position. In this embodiment, the printing platform may be further decelerated when the printing platform is within the threshold distance to the preset starting position, thereby the inertia effect of the printing platform may be reduced to a greater extent, and the shift from the preset starting position of the printing platform due to the inertia may be avoided, and the resetting of the preset starting position may be more precise.

Embodiment Six

Figure 7:
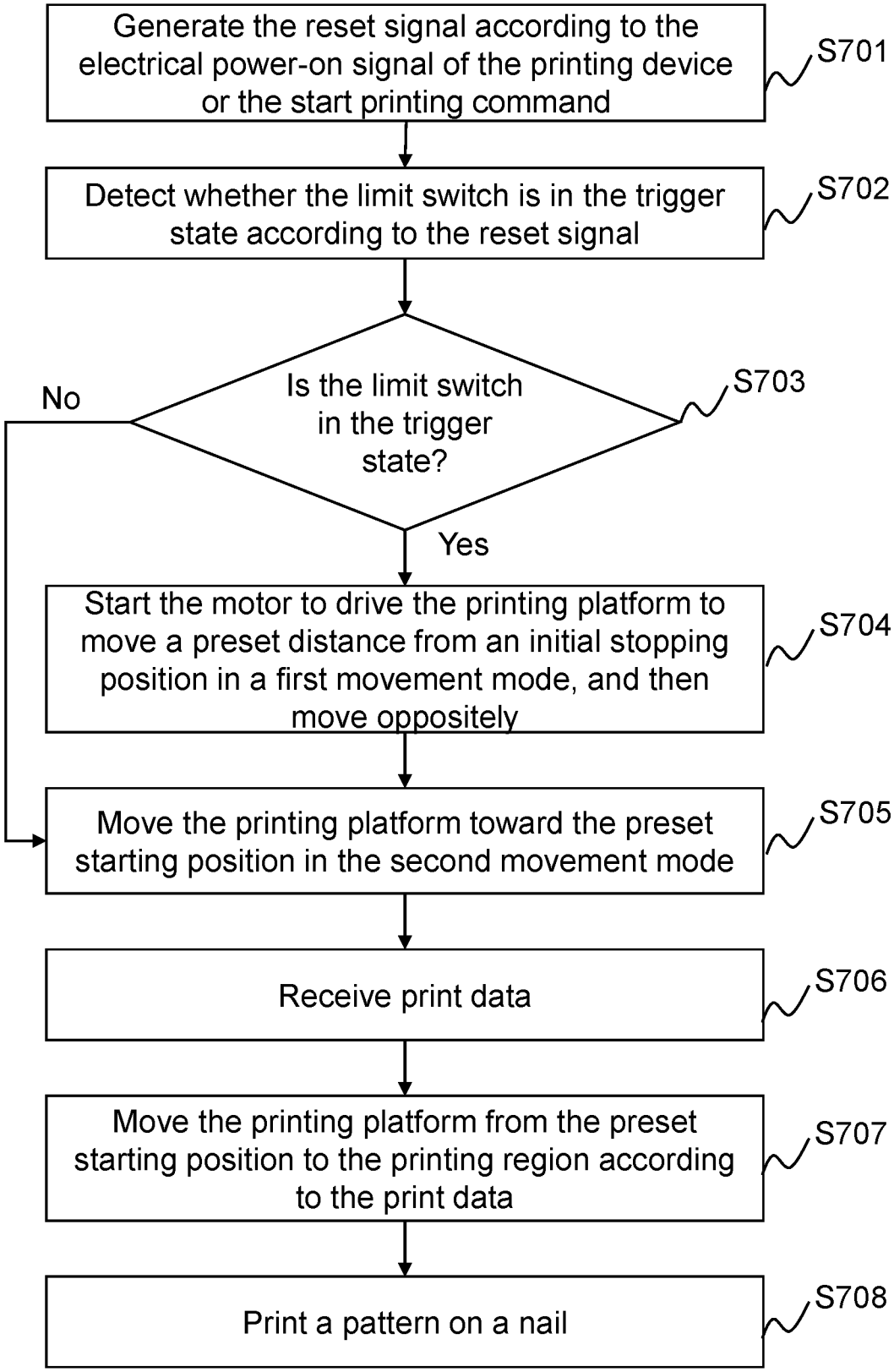
FIG. 7 is a flow chart of the printing control method provided according to a sixth embodiment of the present disclosure.

FIG. 7 is a flow chart of the printing control method provided according to a sixth embodiment of the present disclosure. Based on the embodiment, the method of the embodiment specifically includes operations as described below.

S701, the printing device may generate a reset signal according to an electrical power-on signal of the printing device or a start printing command.

S702, the printing device may detect whether the limit switch is in a trigger state according to the reset signal.

S703, the printing device may determine whether the limit switch is in the trigger state. If the limit switch is in the trigger state, step S704 is executed, otherwise step S705 is executed.

S704, the printing device may start the motor to drive the printing platform to move a preset distance from an initial stopping position in a first movement mode, and then move oppositely.

S705, the printing device may control the printing platform to move toward the preset starting position in a second movement mode. When the state of the limit switch is detected to change from a non-trigger state to the trigger state, the motor stops, and the position of the printing platform when the motor stops is set as the preset starting position.

S706, the printing device may receive print data.

S707, the printing device may control the printing platform to move from the preset starting position to the printing region according to the print data.

S708, the printing device may print a pattern on a nail.

For the steps S707-S708, in some embodiments, the reset signal may be a printing start signal or the reset signal generated according to the printing start signal. The printing device resets the preset starting position of the printing platform when receiving the printing start signal or the reset signal, and then controls the motor to move the printing platform to enter the printing region to reciprocate for printing. The position of the printing platform is determined by the distance measuring apparatus such as the laser distance-measuring module or the grating module to achieve the accurately printing. Taking the grating module as an example, the processor records the number counts of the grating signals, and determines whether to control the motor inversion according to the number counts of the grating signals to make the printing platform reciprocate in the preset printing region for printing.

In some embodiments, after determining the preset starting position of the printing platform, when the printing platform moves away from the preset starting position, the number counts of the grating signals is accumulated. When the number counts of the grating signals reaches a first threshold number, the printing platform is located at a first position, and the motor is controlled to drive the printing platform reversely moving. When the printing platform moves toward the preset starting position, the number counts of the grating signals is subtracted. When the number counts of the grating signals reaches a second threshold number, the printing platform is located at a second position, and the motor is controlled to drive the printing platform reversely moving again. The second position is located between the first position and the preset starting position, and the printing region is defined between the second position and the first position. An inkjet region is also set in the printing region. In some embodiments, when the printing platform operates in the inkjet region, the motor is controlled to rotate at a constant speed, so that the printing platform moves at a uniform speed in the inkjet region at a first printing speed. The motor is controlled to decelerate when the printing platform moves away from the inkjet region to the first position or the second position, so that the speed of the printing platform is 0 when the printing platform reaches the first position or the second position. The motor is controlled to accelerate when the printing platform moves from the second position or the first position to the inkjet region, so that the speed of the printing platform is the first printing speed when the printing platform reaches the inkjet region. When the printing device receives printing end signal, the processor controls the printing platform to stop at the preset starting position.

In some embodiments, after resetting the preset starting position of the printing platform when the printing device is powered on, the steps of printing a pattern on a nail is provided. The printing device of the present disclosure may provide more accurate nail printing. The printing device of the present disclosure may increase the printing efficiency and ensure the quality of the printing by controlling the movements of the printing platform inside and outside the inkjet region at different speeds, thereby improving the efficiency of the printing device.

Embodiment Seven

FIG. 8 is a schematic structural diagram of a printing control apparatus provided according to the seventh embodiment of the present disclosure. The printing control apparatus 800 may be implemented by software and/or hardware and is generally integrated in one terminal. The printing control apparatus 800 may set the preset starting position of the printing platform by performing the printing control method, so that the printing device equipped with the printing control apparatus 800 may accurately perform nail pattern printing on a target nail based on the preset starting position.

In some embodiments, the printing control apparatus 800 may include a limit switch detection module 801, a moving route control module 802, and a starting point determination module 803.

The limit switch detection module 801 may be configured to detect whether the limit switch is in the trigger state when receiving the electrical power-on signal of the printing device or the start printing command.

The moving route control module 802 may be configured to control the printing platform to move according to the state of the limit switch and a corresponding route strategy.

The starting point determination module 803 may be configured to control the printing platform to stop moving when it is detected that the state of the limit switch changes from the non-trigger state to the trigger state, so that the printing platform stops at the preset starting position.

Further, if the limit switch is in the trigger state, the starting point determination module 803 may start the motor to drive the printing platform to move a preset distance from the initial stopping position, and then drive the printing platform to move oppositely. If the limit switch is in the non-trigger state, the starting point setting module 803 may start the motor to drive the printing platform to move toward the preset starting position.

The printing control apparatus 800 may further include a grating module 804, and the grating module 804 may include a grating and an optical grating transducer. The determining whether the print platform moves the preset distance from the initial stopping position may include: generating grating signal by the grating module 804 while the optical grating transducer moving with the printing platform relative to the grating, and determining whether the printing platform moves the preset distance by determining whether a number counts of the grating signals reaches the preset number.

The printing control apparatus 800 may further include a laser distance-measuring module 805. The determining whether the print platform moves the preset distance from the initial stopping position may include: determining, by the laser distance-measuring module 805, an initial coordinate of the printing platform at the initial stopping position and a current coordinate of the printing platform when moving; determining a current moving distance of the printing platform according to the current coordinate and the initial coordinate of the printing platform; and determining whether the printing platform moves the preset distance from the initial stopping position according to the current moving distance.

The printing control apparatus 800 may further include a movement mode control module 806. The movement mode control module 806 may be configured to determine a first movement mode of the printing platform when the printing platform moves from the initial stopping position. The movement mode control module 806 may be configured to further determine a second movement mode of the printing platform when the printing platform moves toward the preset starting position. The first movement mode is different from the second movement mode. In one embodiment, the first movement mode and the second movement mode are both uniform motions, and a first speed of the first movement mode is greater than a second speed of the second movement mode. In another embodiment, the first movement mode includes a first speed, the second movement mode includes a second speed and a third speed. When a distance between a position of the printing form and the preset starting position is greater than a threshold distance, the printing platform moves at the second speed. When the distance between the position of the printing form and the preset starting position is not greater than the threshold distance, the printing platform moves at the third speed. The third speed is less than the second speed, and the second speed is less than or equal to the first speed.

The printing control apparatus 800 may further include a pattern printing control module 807 configured to receive print data. The printing platform may move from the preset starting position to the printing region according to the print data and print a pattern on a nail.

Compared to the prior art, the printing control apparatus 800 of the present disclosure may perform the printing control method of the foregoing embodiments, and thus all the advantages of the foregoing embodiments may be implemented, and details are not described herein again.

Embodiment Eight

Figure 9:
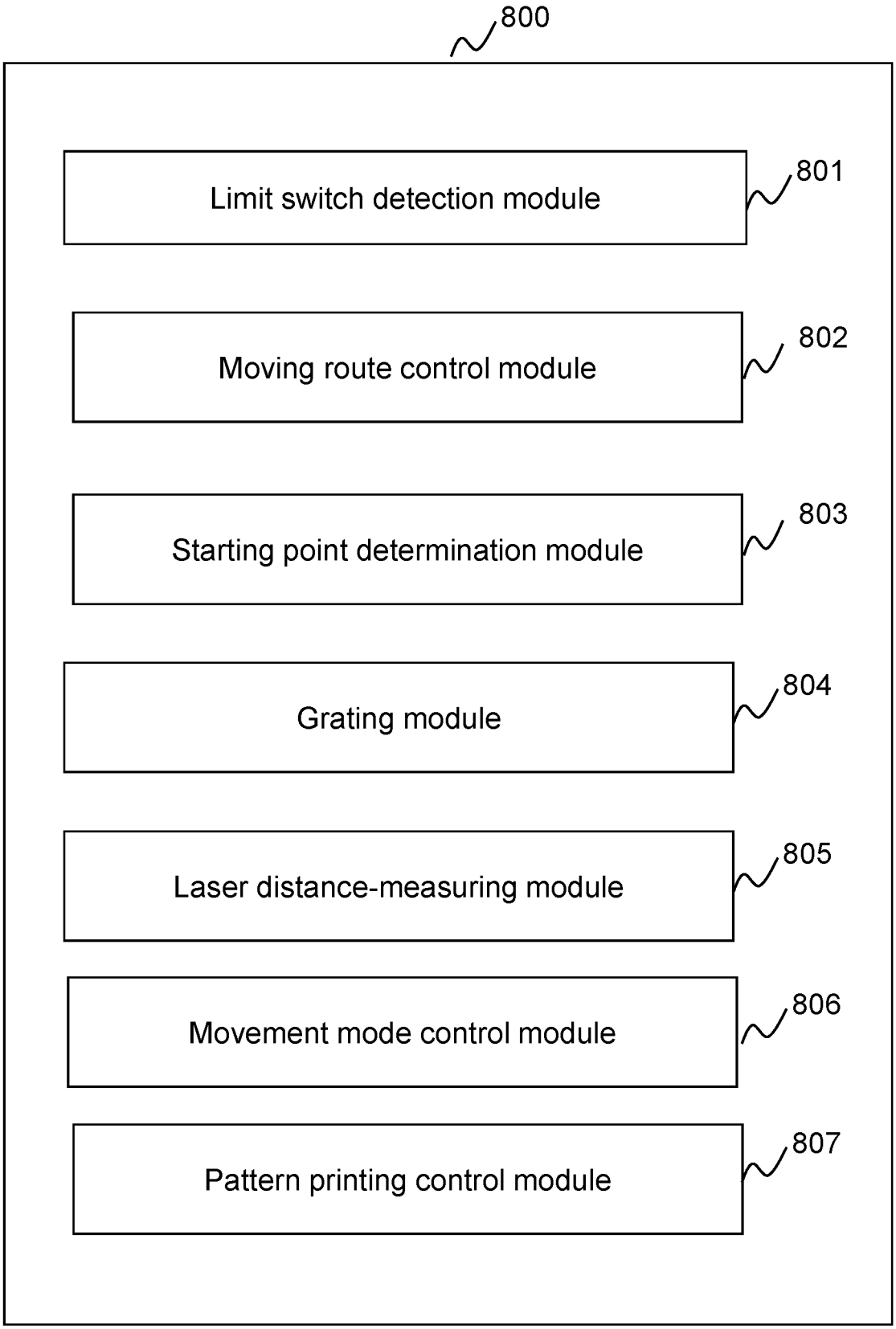
FIG. 9 is a schematic structural diagram of a printing device provided according to an eighth embodiment of the present disclosure.
Figure 9:
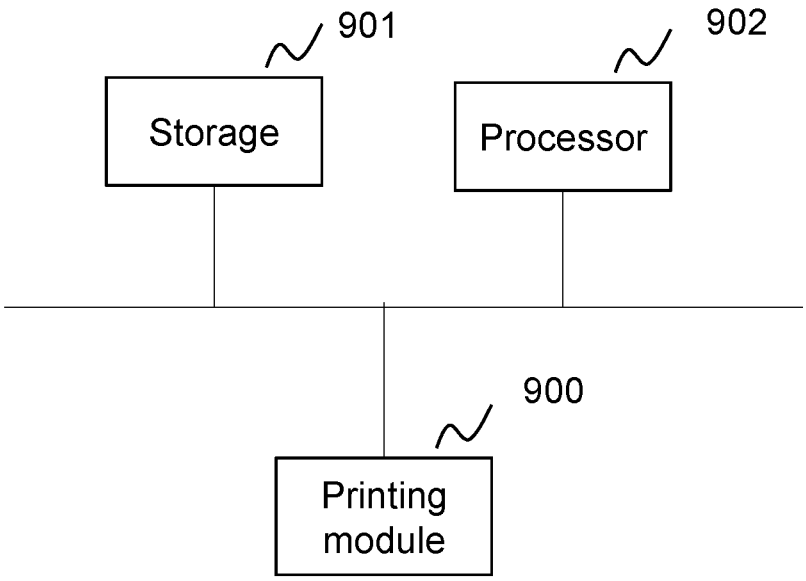

FIG. 9 is a schematic structural diagram of the printing device provided according to an eighth embodiment of the present disclosure. As shown in FIG. 9, the printing device may include a processor 902, a storage 901, and a printing module 900. The number of processors 902 in the printing device may be one or more. FIG. 9 illustrates one processor as an example. The processor 902 and the storage 901 may be connected by a bus or other connection, and FIG. 9 uses the bus connection as an example.

As an computer-readable storage medium, the storage 901 may be used to store a software program, computer executable instructions and/or modules, such as a program instruction/module corresponding to the printing control method in the present disclosure (for example, the limit switch detection module 801, the moving route control module 802, and the starting point determination module 803 of the printing device). The processor 902 may execute software programs, instructions, and modules stored in the storage 901 to achieve various functions and data processing of a device/terminal/server, e.g., the printing control methods.

The storage 901 may mainly include a program storage and a data storage, wherein the program storage may store an operation system, at least one function needed application program. The data storage may store data generated according to the use of the terminal or the like. In addition, the storage 901 may include a high-speed-random-access storage or a non-transitory storage, such as a disk storage device, a flash memory device, or other non-volatile solid storage components. In some examples, the storage 901 may further include a storage remotely set relative to the processor 902, which may be connected to the device/terminal/server via a network. Examples of the network may include, but are not limited to, Internet, an intranet, a local area network, a mobile communication network, or the like, or any combinations thereof.

The printing module 900 may be configured to perform printing on the nail according to a preset pattern.

A storage medium may include any of various types of storage devices or storing devices. The term "storage medium" may include: a mounting medium (such as a CD-ROM, a floppy disk, or a tape device), a computer system storage or a random access storage (such as DRAM, DDRRAM, SRAM, EDORAM, Rambus RAM, etc.), a non-volatile storage (such as a flash memory and a magnetic media (such as a hard disk or an optical storage)), a register or other similar type of storage components, etc. The storage medium may also include other types of the storage or any combinations thereof. In addition, the storage medium may be located in a first computer system in which the program is executed or may be located in a second computer system which is connected to the first computer system via a network such as the Internet. The second computer system may provide program instructions to the first computer for execution. The term "storage medium" may include two or more storage mediums that may reside in different locations (e.g., in different computer systems connected by the network). The storage medium may store the program instructions that may be executed by one or more processors (e.g., implemented as the computer program).

The present disclosure also provides the storage medium containing computer executable instructions. The computer executable instructions are not limited to the printing control method as described above but may also perform related operations in the printing control method provided by any of the embodiments of the present disclosure.

In one embodiment, the storage medium comprising computer executable instructions provided by the present disclosure embodiment, the computer executable instructions, when executed by the computer processor, caused the computer processor executing the printing control method, the method comprising operations as described below.

The processor may detect whether the limit switch is in the trigger state when receiving the electrical power-on signal of the printing device or the start printing command.

The processor may control the printing platform to move according to the state of the limit switch and the corresponding route strategy.

The processor may control the printing platform to stop moving when it is detected that the state of the limit switch changes from the non-trigger state to the trigger state, so that the printing platform stops at the preset starting position.

The storage medium containing the computer executable instructions is provided by the present disclosure embodiment. The computer executable instructions are not limited to the above method operations and may also perform related operations in the printing control method provided by any of the embodiments of the present disclosure.

Through the above description of the embodiment, it will be apparent to those skilled in the art that the present disclosure may be implemented by means of the software and the necessary general hardware, and of course by the hardware, but in many cases the former is a better embodiment. Based on this understanding, the technical solutions of the present disclosure may be embodied in the form of software products. The computer software product may be stored in the computer readable storage medium, such as a computer floppy disk, a read-only storage (Read-Only Memory, ROM), a random access storage (Random Access Memory, RAM), a flash memory (FLASH), a hard disk or a CD, etc. The computer readable storage medium includes instructions for causing the computer device (maybe a personal computer, a server, a network device, etc.) to perform the methods of the various embodiments of the present disclosure.

Figure 10:
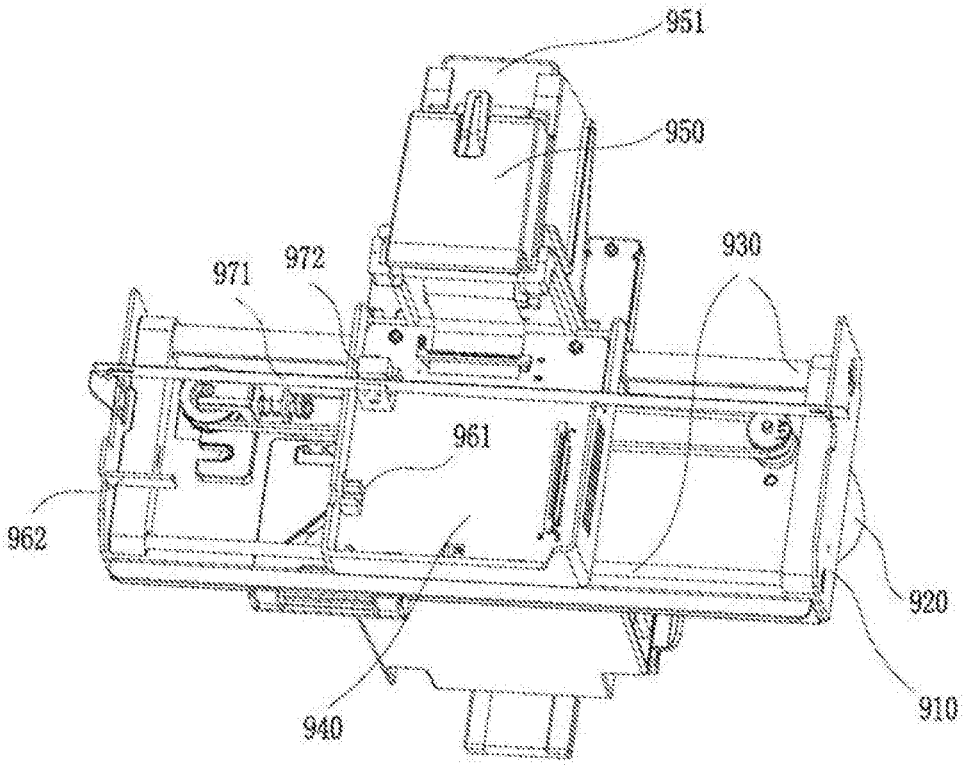
FIG. 10 is a schematic structural diagram of a printing module used in the printing device provided according to the eighth embodiment of the present disclosure.

FIG. 10 is a schematic structural diagram of a printing module used in the printing device provided according to the eighth embodiment of the present disclosure.

The printing module may include a frame 910, a motor 920, a slider 930 (X axis), a printing platform 940, a limit switch 961, and a trigger board 962. The motor 920 and the slider may be fixed to the frame 910, and the slider 930 may be along a longitudinal direction of the frame 910. The printing platform 940 may be driven by the motor 920 via a belt (not shown) to move along the slider 930. In some embodiments, the printing platform 940 may be equipped with an ink cartridge holder 950, and the ink cartridge holder 950 is provided with a detachable ink cartridge 951 and an inkjet print head which is connected to the ink cartridge 951.

In some embodiments, the limit switch 961 is a photoelectric limit switch. The photoelectric limit switch includes two oppositely disposed pins for transmitting and receiving optical signal. The trigger board 962 may be configured to block the optical path between the two pins of the photoelectric limit switch. In one embodiment, one of the limit switch 961 or the trigger board 962 is disposed on the printing platform 940, and the other of the limit switch 961 or the trigger board 962 is fixed adjacent to an end of the slider 930 for defining the preset starting position. In one embodiment, the limit switch 961 is disposed on the printing platform 940, and the trigger board 962 is fixed at one end of the slider 930 for defining the preset starting position. When the limit switch 961 is in the preset starting position, the optical path between the two pins being blocked by the trigger board 962, the photoelectric limit switch generates the first trigger signal of the low voltage. When the photoelectric limit switch 961 leaves the preset starting position, the optical path between the two pins is not blocked by the trigger board 962, and the photoelectric limit switch 961 generates the second trigger signal of the high voltage. The processor determines whether the photoelectric limit switch is in the trigger state based on the first or the second trigger signal provided by the photoelectric limit switch 961. For example, the processor may determine whether the photoelectric limit switch is in the preset starting position and whether the optical path between the photoelectric limit switches is blocked by the trigger board 962. In an alternative embodiment, the trigger board 962 may be disposed on the printing platform, and the limit switch 961 is fixed at one end of the slider 930 for defining the preset starting position.

In some embodiments, the printing module may further include a grating module, which is used as the distance measuring apparatus to calculate the distance between the printing platform 940 and a reference point, such as the preset starting position or the initial stopping position. The grating module includes a grating 971 arranged in parallel along the slider 930 and an optical grating transducer 972. The optical grating transducer and the grating are slidable coupled to each other. The optical grating transducer is set on an upper slider of the X axis or on the printing platform 940. The optical grating transducer 972 of the grating module moves with the printing platform 940 along the X axis. A grating signal is generated when the optical grating transducer 972 passes each grid of light grid of the grating 971 during the movement, and the grating signals are counted. When the number counts of the grating signals reaches the preset number, the printing platform 940 is considered to move away a distance to the reference point, such as the preset distance to the preset starting position.

Figure 11:
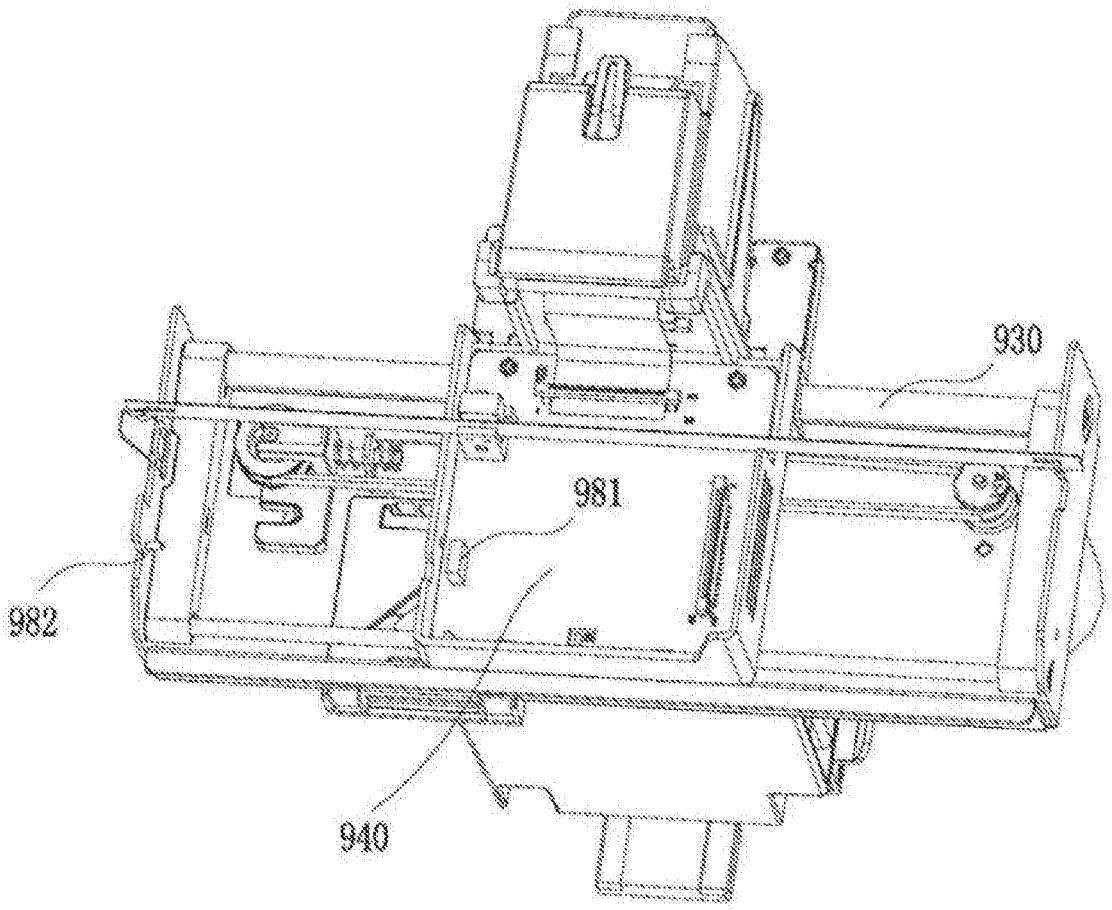
FIG. 11 is a schematic structural diagram of another printing module used by the printing device provided according to the eighth embodiment of the present disclosure.

FIG. 11 is a schematic structural diagram of another printing module used by the printing device provided according to the eighth embodiment of the present disclosure.

The print module may further include a reflector 981 set on the printing platform 940, and a laser transmitter/receiver 982 fixed at the preset starting position of the printing platform 940. The reflector 981 and the laser transmitter/receiver 982 form the laser distance-measuring module. In this embodiment, the laser distance-measuring module may accurately identify the movement coordinates of the printing platform 940 along the slider 930, so the distance of the printing platform 940 moving away from the reference point (for example, the initial stopping position) may also be calculated. Specifically, the laser distance-measuring module is controlled to obtain the current coordinate of the printing platform 940 when the printing platform 940 moves and the initial coordinate of the printing platform 940 before the printing module moves. The current moving distance of the printing platform 940 is calculated according to the current coordinate and the initial coordinate of the printing platform 940. Whether the printing platform 940 movement reaches the preset distance is determined based on the current movement distance for the resetting process or the accurate printing. In an alternative embodiment, the laser transmitter/receiver 982 may be set on the printing platform 940, and the reflector 981 may be fixed at the preset starting position of the printing platform 940.

Compared to the prior art, the printing device of the present disclosure is used to perform the printing control methods of the foregoing embodiments, and therefore all the advantages of the foregoing embodiments may be implemented, and details are not described herein again.

It should be noted that in the embodiment of the printing control apparatus, the units and the modules are only divided according to the function logic, but are not intended to limit, as long as the corresponding function can be implemented. In addition, the specific names of the function units are only for the convenience, and are not used to limit the scope of protection of the present disclosure.

Note that illustrated descriptions above are only preferred embodiments of the present disclosure and the technical principles applied. A person skilled in the art may understand that the present disclosure is not limited to the specific embodiments herein, and that various modifications, alterations and substitutions can be made by those skilled in the art without departing from the scope of the disclosure. Therefore, although the present disclosure has been described in more details by the above embodiments, the present disclosure is not limited to the above embodiments, and many other equivalent embodiments may be included without departing from the scope of the present disclosure, and the scope of the present disclosure is determined by the scope of the appended claims.

What is claimed is:

1. A printing control method for resetting a printing platform of a printing device to a preset starting position, comprising:

detecting a state of a limit switch of the printing device when receiving an electrical power-on signal of the printing device or a start printing command, the state of the limit switch including a trigger state or a non-trigger state;

moving the printing platform according to the state of the limit switch and a route strategy, which comprises:

driving, by a motor, the printing platform to move a preset distance from an initial stopping position along a first direction, which is designated as a first movement mode, and then to move along a second direction opposite to the first direction if the limit switch is in the trigger state;

driving, by the motor, the printing platform to move toward the preset starting position, which is designated as a second movement mode, if the limit switch is in the non-trigger state, wherein the second movement mode is different from the first movement mode;

wherein the first movement mode and the second movement mode are both uniform motions, and a first speed of the first movement mode is larger than a second speed of the second movement mode; and controlling the printing platform to stop moving at the preset starting position when the state of the limit switch is changed from the non-trigger state to the trigger state.

2. The printing control method of claim 1, wherein the printing device further comprises a grating module, the grating module includes a grating and an optical grating transducer, the optical grating transducer is fixed to the printing platform, and determining whether the driving the printing platform has moved the preset distance from the initial stopping position along the first direction includes:

controlling the printing platform to move relative to the grating so as to generate grating signals by the optical grating transducer due to a relative movement between the optical grating transducer and the grating;

determining whether a number counts of the grating signals reaches a preset number counts.

3. The printing control method of claim 2, wherein, the printing platform's move from the initial stopping position is designated as a first movement mode; and the printing platform's move toward the preset starting position is designated as a second movement mode, the second movement mode being different from the first movement mode.

4. The print control method of claim 3, further comprising controlling the printing platform to move from the preset starting position toward a printing region according to print data and tracking the grating signals, wherein when the number counts of the grating signals reaches a first threshold number, the printing platform is located at a first position; when the number counts of the grating signals reaches a second threshold number, the printing platform is located at a second position, and wherein the printing region is located between the first position and the second position.

5. The print control method of claim 4, wherein the printing region includes an inkjet region, and the method further comprising:

controlling the printing platform to move at a uniform speed in the inkjet region;

controlling the printing platform to decelerate when the printing platform moves away from the inkjet region to the first position or the second position, and the speed of the printing platform is 0 when the printing platform reaches the first position or the second position;

controlling the printing platform to accelerate when the printing platform moves from the second position or the first position toward the inkjet region, and the speed of the printing platform is the uniform speed when the printing platform reaches the inkjet region.

6. The print control method of claim 1, wherein the printing device further comprises a laser distance-measuring module, and determining whether the driving the printing platform to move the preset distance from the initial stopping position along the first direction includes:

determining, by the laser distance-measuring module, an initial coordinate of the printing platform at the initial stopping position and a current coordinate of the printing platform when moving;

determining a current moving distance of the printing platform according to the current coordinate and the initial coordinate of the printing platform; and determining whether the printing platform moves the preset distance from the initial stopping position based on the current moving distance.

7. The printing control method of claim 6, wherein, the printing platform's move from the initial stopping position is designated as a first movement mode; and the printing platform's move toward the preset starting position is designated as a second movement mode, the second movement mode being different from the first movement mode.

8. The printing control method of claim 7, wherein, the first movement mode and the second movement mode are both uniform motions, and the first speed of the first movement mode is larger than the second speed of the second movement mode.

9. The printing control method of claim 7, wherein, the first movement mode includes the first speed, the second movement mode includes the second speed and a third speed, the printing platform moves at the second speed when a distance between the printing platform and the preset starting position is larger than a threshold distance;

the printing platform moves at the third speed when the distance between the printing platform and the preset starting position is smaller than the threshold distance;

the third speed is less than the second speed and the second speed is less than or equal to the first speed.

10. A non-transitory computer-readable medium storing instructions, the instructions, when executed by a processor, caused the processor to implement a printing control method according to claim 1.

* * * * *